US009849947B2

(12) United States Patent
Longman

(10) Patent No.: US 9,849,947 B2
(45) Date of Patent: Dec. 26, 2017

(54) DOCKING CONTROL FOR VESSELS

(71) Applicant: Nauti-Craft Pty Ltd, Western Australia (AU)

(72) Inventor: Michael James Longman, Western Australia (AU)

(73) Assignee: Nauti-Craft Pty Ltd, Western Australia (AU)

( * ) Notice: Subject to any disclaimer, the term of this patent is extended or adjusted under 35 U.S.C. 154(b) by 16 days.

(21) Appl. No.: 15/104,287

(22) PCT Filed: Dec. 11, 2014

(86) PCT No.: PCT/AU2014/001118

§ 371 (c)(1),
(2) Date: Jun. 14, 2016

(87) PCT Pub. No.: WO2015/085352

PCT Pub. Date: Jun. 18, 2015

(65) Prior Publication Data

US 2016/0355241 A1 Dec. 8, 2016

(30) Foreign Application Priority Data

Dec. 11, 2013 (AU) ..... 2013904833

(51) Int. Cl.
*B60L 3/00* (2006.01)
*B60L 15/00* (2006.01)
(Continued)

(52) U.S. Cl.
CPC ..... *B63B 39/04* (2013.01); *B63B 1/14* (2013.01); *B63B 27/14* (2013.01); *B63B 27/30* (2013.01);
(Continued)

(58) Field of Classification Search
CPC ..... B63B 39/04; B63B 59/02; B63B 27/30; B63B 27/14; B63B 1/14; B63B 2017/0072; B63B 2001/145
(Continued)

(56) References Cited

U.S. PATENT DOCUMENTS 4,137,861 A * 2/1979 Brummenaes ..... E02B 3/26 114/219
6,763,774 B1 * 7/2004 Ranieri ..... B63B 39/005 114/191
(Continued)

FOREIGN PATENT DOCUMENTS

WO 2013181699 12/2013
WO 2014153600 10/2014

OTHER PUBLICATIONS

International Search Report and Written Opinion for Application No. PCT/AU2014/001118 dated Jan. 27, 2015 (9 pages).

*Primary Examiner* — Jaime Figueroa
(74) *Attorney, Agent, or Firm* — Michael Best & Friedrich LLP

(57) ABSTRACT

A control system for a suspension system of a multi-hulled vessel, the vessel including a chassis portion, at least two hulls moveable relative to the chassis portion. The suspension system of the vessel provides support of at least a portion of the chassis above the at least two hulls, and includes adjustable supports and at least one motor to enable adjustment of a support force and/or displacement of the adjustable supports. The control system includes a fender friction force input for receiving at least one signal indicative of a friction force on a fender portion between a fixed or floating object and the vessel chassis portion, and in response to the fender friction force input, the control system is to adjust the support force and/or displacement between
(Continued)

the chassis portion and the at least two hulls to reduce or minimize the friction force on the fender portion.

21 Claims, 4 Drawing Sheets

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |
| ***B63B 39/04*** | (2006.01) |
| ***B63B 1/14*** | (2006.01) |
| ***B63B 27/14*** | (2006.01) |
| ***B63B 27/30*** | (2006.01) |
| ***B63B 59/02*** | (2006.01) |
| *B63B 17/00* | (2006.01) |

(52) U.S. Cl.
CPC ..... *B63B 59/02* (2013.01); *B63B 2001/145* (2013.01); *B63B 2017/0072* (2013.01)

(58) Field of Classification Search
USPC ..... 701/1, 21
See application file for complete search history.

(56) References Cited

U.S. PATENT DOCUMENTS

| | | | | |
|---|---|---|---|---|
| 7,293,519 | B2 * | 11/2007 | Montgomery | B63B 21/00 114/230.1 |
| 8,215,256 | B2 * | 7/2012 | Montgomery | B63B 21/00 114/230.1 |
| 8,484,787 | B2 * | 7/2013 | Voyiadjis | F16F 7/12 14/75 |
| 9,027,496 | B2 * | 5/2015 | Zucco | B63B 21/00 114/230.15 |
| 9,073,605 | B2 * | 7/2015 | Hall | B63B 17/0081 |
| 2001/0029879 | A1 * | 10/2001 | Cottrell | B63B 21/00 114/230.19 |
| 2006/0081166 | A1 * | 4/2006 | Montgomery | B63B 21/00 114/230.1 |
| 2006/0081169 | A1 * | 4/2006 | Waldock | B63B 1/121 114/362 |
| 2008/0156244 | A1 * | 7/2008 | Montgomery | B63B 21/00 114/230.1 |
| 2010/0012009 | A1 * | 1/2010 | Montgomery | B63B 21/00 114/230.1 |
| 2013/0213288 | A1 * | 8/2013 | Hall | B63B 17/0081 114/85 |
| 2013/0233225 | A2 | 9/2013 | Heyring et al. | |
| 2013/0233226 | A2 * | 9/2013 | Heyring | B63B 1/14 114/61.15 |

* cited by examiner

DOCKING CONTROL FOR VESSELS

FIELD OF THE INVENTION

The present invention relates to improvements in suspension systems for vessels having a chassis portion and one or more hulls and specifically relates to control of the suspension system when the chassis is docked against a fixed or floating object.

BACKGROUND OF THE INVENTION

There are known many vessels incorporating suspension systems to resiliently and/or adjustably support a chassis portion, at least partially, relative to one or more hulls. The Applicant's United States patent application publication numbers US2013/0233225 and US2013/0233226 show various arrangements of interconnected suspension systems for multi-hulled vessels and United States patent application publication number US2013/0213288 describes an alternative type of control actuator. The Applicant's international patent application publication number WO2013/181699 discloses a suspension geometry primarily suited to catamarans and WO2014/153600 discloses stabilisation of the chassis portion utilising gyroscopic stabilisers.

None of these advanced vessels providing suspension of the chassis portion are yet in operation on commercial offshore wind farms for example where currently conventional closed-tunnel rigid catamarans are most often used for ferrying personnel and parts to the pylon or foundation supporting each wind turbine. When the vessel reaches a pylon, the vessel is docked with the pylon by pushing the bow of the vessel into the side of the pylon to help generate sufficient friction between the vessel and the pylon to reduce relative motion. The personnel then have to judge when little relative motion is likely and transfer between the vessel and pylon as quickly as possible. This transfer activity increases in risk as the sea state increases.

It has been proposed to use multi-hulled vessels with resiliently suspended chassis portions to improve the safety of these transfers. The greater the improvement in steady state performance of a vessel docked with a pylon, the greater the safety margin, the higher the number of days servicing operations can be carried out and/or the smaller the service vessel may be thereby improving the safety and efficiency of the offshore wind farm.

It would therefore be desirable to provide a control system for a vessel incorporating a suspended chassis, the control system minimising relative motion between the pylon and at least a portion of the chassis.

SUMMARY OF THE INVENTION

According to a first aspect of the invention there is provided a control system for controlling at least a suspension system of a multi-hulled vessel, the vessel including a chassis portion, at least two hulls moveable relative to the chassis portion, the suspension system providing support of at least a portion of the chassis above the at least two hulls, the suspension system including adjustable supports (for example hydraulic rams, pneumatic springs and/or electromagnetic actuators) and at least one motor to enable adjustment of a support force and/or displacement of the adjustable supports, the control system including a fender friction force input for receiving at least one signal indicative of a friction force on a fender portion between a fixed or floating object and the vessel chassis portion, and in response to fender friction force input, the control system being arranged to adjust the support force and/or displacement between the chassis portion and the at least two hulls to reduce or minimise the friction force on the fender portion.

At least one fender friction force sensor may be provided for supplying said at least one signal indicative of a friction force on the fender portion between the fixed or floating object and the vessel chassis portion.

The fender may be attached to the chassis of the vessel.

The control system may further include at least one fender reaction force input for receiving a signal indicative of a reaction force between the chassis of the vessel and the fixed or floating object. For example the reaction force may be perpendicular to the friction force and/or may be generated from a measured compression of the fender. The control system may increase or decrease a propulsion thrust in dependence on the signals received by the at least one fender friction force input and the at least one fender reaction force input. For example if the magnitude of the friction force is greater than a predetermined percentage of the magnitude of the reaction force, the propulsion force can be increased. Similarly, if a time averaged magnitude of the friction force is less than a predetermined percentage of the magnitude of the reaction force, the propulsion force can be decreased.

The adjustable supports may be adjusted to reduce or minimise the friction force on the fender portion.

The adjustable supports may include four adjustable supports being a front left, a front right, a back left and a back right adjustable support.

The at least two hulls may be a left hull and a right hull, the front left and back left adjustable supports being longitudinally spaced on the left hull and the front right and back right adjustable supports being longitudinally spaced on the right hull.

Alternatively, the at least two hulls may be a front left hull, a front right hull, a back left hull and a back right hull, the respective front left or front right adjustable support being located between a forward portion of the chassis portion and the respective hull, and the respective back left or back right adjustable support being located between a rearward portion of the chassis portion and the respective hull.

When a forward or rearward end of the vessel is adjacent the fixed or floating object, the control system may adjust the front left and front right supports and/or the back left and back right supports to reduce or substantially eliminate the vertical force in the fender portion while allowing the chassis portion to pitch. For example, if the bow of the vessel is adjacent the fixed or floating object, the pitch attitude of the chassis portion may be adjusted by adjusting the displacement of the front left and front right supports, or alternatively by adjusting the displacement of the front left and front right supports in an opposite direction to the back left and back right supports.

When a left or right side of the vessel is adjacent the fixed or floating object, the control system may adjust the front left and back left supports and/or the front right and back right supports to reduce or substantially eliminate the vertical force in the fender portion while allowing the chassis portion to roll. For example, if the left side of the vessel is adjacent the fixed or floating object, the roll attitude of the chassis portion may be adjusted by adjusting the displacement of the front left and back left supports, or alternatively by adjusting the displacement of the front left and back left supports in an opposite direction to the front right and back right supports.

The fender may be attached to the fixed or floating object.

According to a second aspect of the invention there is provided a method of controlling a chassis portion of a vessel, the vessel including a chassis portion, at least two hulls and a suspension system providing support of at least a portion of the chassis above the at least two hulls, and a suspension control system, the suspension control system including at least two modes of operation including a docked mode, the method including the steps of: sensing a friction force in a fender portion between the chassis of the vessel and a fixed or floating object; and in response to the sensed friction force, adjusting the suspension system to reduce or substantially eliminate the friction force in the fender portion.

The method may further include the step of determining when to enter or exit the docked mode, which step may include detecting a docking mode position of a mode selector.

The method may further include the step of sensing at the fender a reaction force between the chassis of the vessel and the fixed or floating object. For example the reaction force may be perpendicular to the friction force and/or may be generated from a measured compression of the fender.

Alternatively or additionally, the step of determining when to enter or exit the docked mode may include comparing the reaction force at the fender to at least one minimum value. For example the at least one minimum value may be an enter docked mode value and an exit docked mode value, the enter docked mode value being higher than the exit docked mode value.

The step of adjusting the suspension system to reduce or substantially eliminate the vertical force in the fender portion may include: adjusting the pitch attitude between the chassis portion and the at least two hulls of the vessel. For example, if the bow of the vessel is adjacent the fixed or floating object and if the vessel is a catamaran and has a left and a right hull, the pitch attitude of the chassis portion may be adjusted relative to the average pitch attitude of the left and right hulls. Alternatively, if the vessel is a quadmaran having two front hulls and two back hulls, the pitch attitude of the chassis portion may be adjusted relative to the at least two hulls by increasing the force or load between the two front hulls and the chassis portion and decreasing the force or load between the two back hulls and the chassis portion (or vice versa).

Alternatively or additionally, the step of adjusting the suspension system to reduce or substantially eliminate the vertical force in the fender portion may include: adjusting the heave attitude of the chassis portion relative to the at least two hulls of the vessel.

Additionally or alternatively, the step of adjusting the suspension system to reduce or substantially eliminate the vertical force in the fender portion may include: adjusting the roll attitude between the chassis portion and the at least two hulls of the vessel. For example, if the side of the vessel is adjacent the fixed or floating object and if the vessel is a catamaran and has a left and a right hull, the roll attitude of the chassis portion may be adjusted relative to the left and right hulls by increasing the force or distance between the left hull and the chassis portion and decreasing the force or distance between the right hull and the chassis portion (or vice versa). Alternatively, if the vessel is a quadmaran having two left hulls and two right hulls, the roll attitude of the chassis portion may be adjusted relative to the at least two hulls by increasing the force or distance between the two left hulls and the chassis portion and decreasing the force or distance between the two right hulls and the chassis portion (or vice versa).

The fender is attached to the chassis of the vessel or alternatively, the fender may be attached to the fixed or floating object.

The invention will be more readily understood from the following description of a number of specific embodiments incorporating one or more features of the invention, and as illustrated in the accompanying drawings. Other arrangements or embodiments are possible, so the provision of the accompanying drawings and the following description thereof should not be taken to limit the scope of the above description of the invention.

DESCRIPTION OF PREFERRED EMBODIMENT

Figure 1:
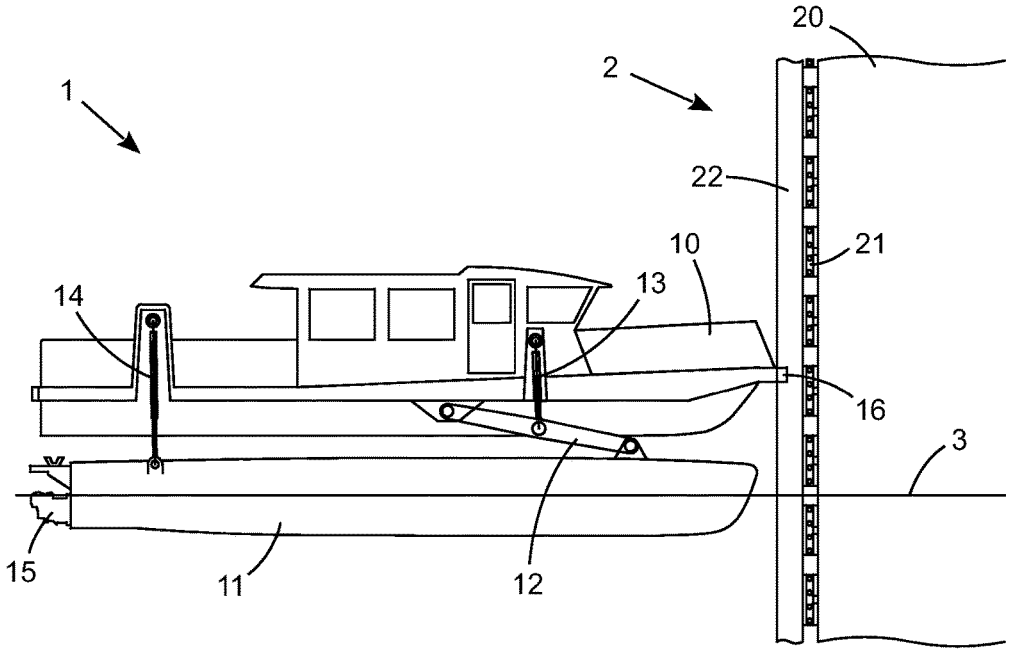
FIG. 1 is a schematic side view of a multi-hulled vessel incorporating suspension, docked against a pylon.

Referring initially to FIG. 1 there is shown a vessel 1 incorporating suspension, the vessel being adjacent a pylon or foundation or other fixed or floating object 2. The water surface 3 is shown flat for simplicity since short and long wavelengths have little effect on hull pitch.

The vessel has a body or chassis portion 10 and at least one hull 11, located by suspension geometry such as the front leading arm 12 to permit vertical, i.e. heave, motions and pitch motions of the hull 11 relative to the chassis 10. Typically, this type of vessel would be a catamaran, i.e. having a left hull and a right hull, only the right hull 11 being visible in FIG. 1. This type of vessel is described in the Applicant's international patent publication number WO 2013/181699, details of which are incorporated herein by reference. The suspension system also includes front and back actuators 13, 14 between the hulls 11 and the forward and rearward portions of the chassis 10. Examples of arrangements of actuators and interconnections can be found in the Applicant's United States patent application publication numbers US2013/0233225 and US2013/0233226 and Australian provisional application number 2014904806, and the use of further alternative actuators is disclosed in United States patent application publication number US2013/0213288, details of all of which are incorporated herein by reference.

When transferring people and/or cargo between the vessel 1 and the pylon 2 it is preferable to limit or prevent relative motion between the two. In the illustrated example, a ladder 21 is fixed to the side of the main body 20 of the pylon 2 and the ladder is protected by vertical poles 22 on either side of the ladder as can be seen in plan view in FIG. 2. With this type of arrangement it is common to use the thrust of the propulsion system 15 to drive a shaped fender portion 16 of the vessel against the poles 22, the shaping of the fender 16 being designed to provide some lateral location of the vessel against the pylon and often including a portion that can be stepped on by personnel transferring between the chassis 10 of vessel and the ladder 21.

Figure 3:
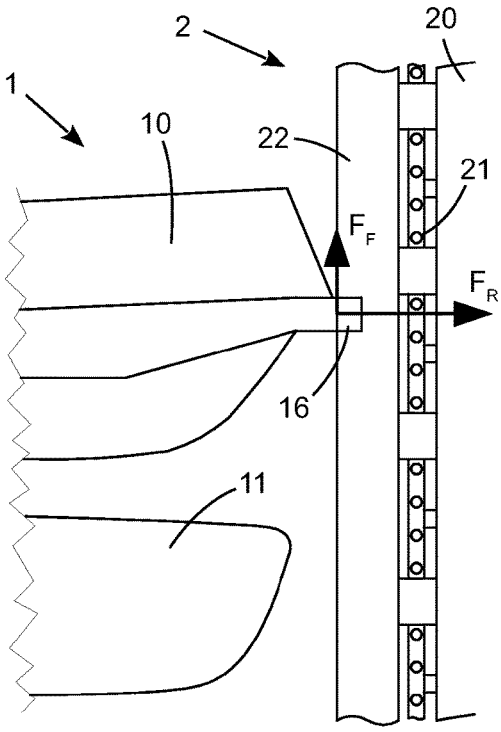
FIG. 3 is a partial view of a portion of FIG. 1.

The use of control systems to maintain a position on the deck, or even the entire deck, at a constant height or position are also known. However, when contact is made and held between the vessel 1 and an object such as the pylon 2, the use of conventional control systems is largely inappropriate as the contact point is restrained from moving vertically. It is possible to use suspension systems with a soft pitch stiffness and this reduces the magnitude of the vertical, largely friction, forces between the vessel chassis and the poles and assists with safe transfers. FIG. 3 shows the front of the vessel 1 against the pylon 2 with the reaction force $F_R$ and the friction force $F_F$ between the vessel and the pylon (from the fender portion 16 of the chassis 10 to the pole 22). In this example the fender portion 16 is part of the vessel so can readily incorporate a friction force sensor and a reaction force sensor. These sensors may well comprise multiple strain gauges or displacement sensors, the out of which is processed to provide a friction force signal or a reaction force signal. The reaction force sensor can alternatively be a simple measure of the longitudinal compression of the fender 16.

Throughout the drawings, equivalent parts are assigned like reference numerals.

Figure 4:
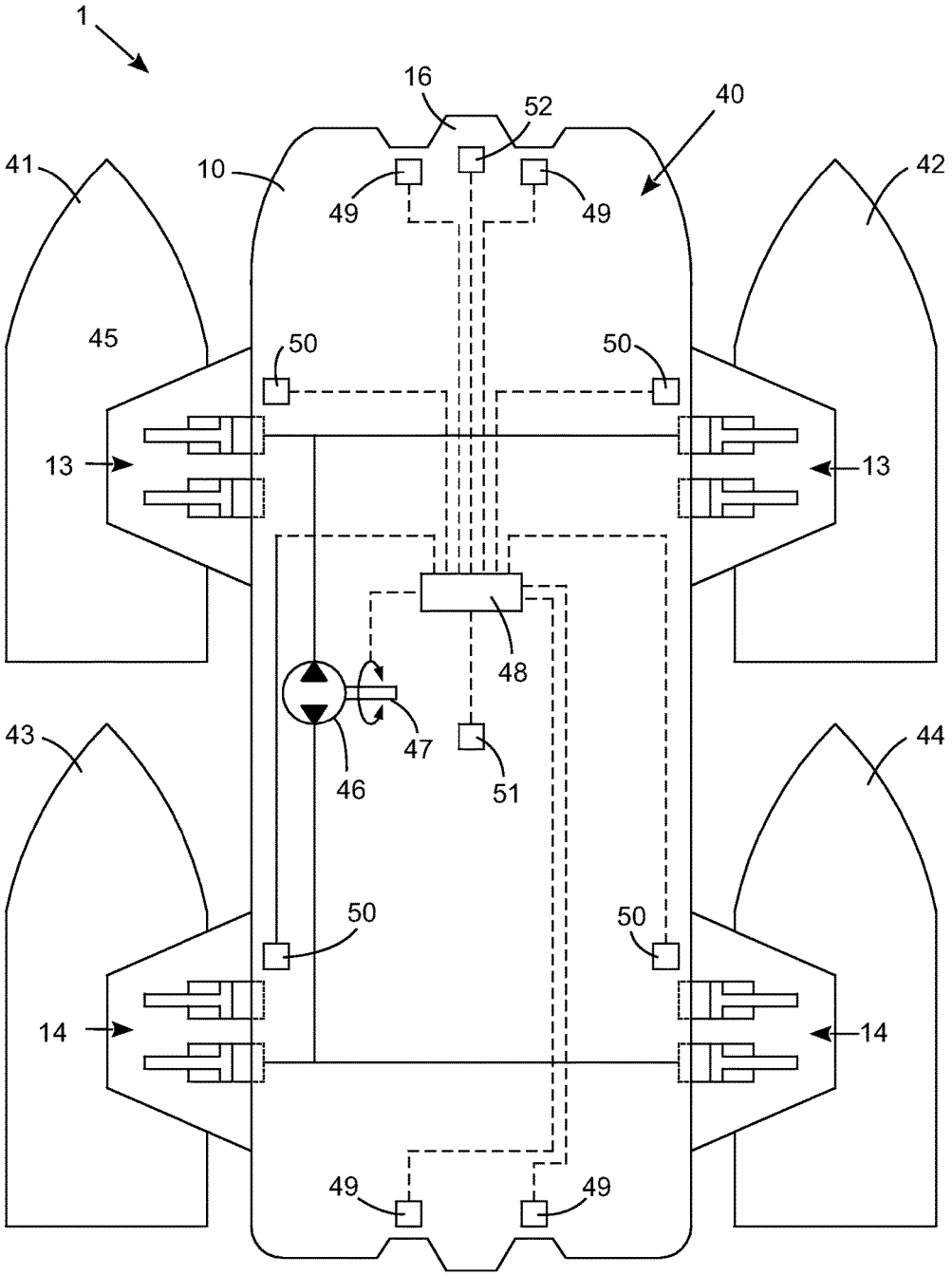
FIG. 4 is a schematic diagram of a vessel including a control system in accordance with an embodiment of the present invention.

FIG. 4 shows a control system 40 on a quadmaran having a front left hull 41, front right hull 42, back left hull 43 and a back right hull 44, each connected to the body 45 by wishbones or other suitable suspension geometry. The chassis portion 10 is supported above the front and back hulls by a pair of parallel actuators 13 or 14 between each wishbone and the chassis, although a single actuator could be used. One actuator of each pair is connected laterally forming a front pair of interconnected actuators and a back pair of interconnected actuators. A pump 46 is provided to enable fluid to be driven between the front pair of interconnected actuators and the back pair of interconnected actuators, the pump being bi-directional and being driven by a reversible motor 47 to enable the pitch attitude of the chassis 10 to be adjusted. The control system 40 includes an electronic control unit 48 able to receive inputs from a number of sensors such as fender friction sensors 49, suspension system displacement and/or pressure sensors 50, an accelerometer 51 able to detect the attitude of the chassis and a bow height sensor 52. Although shown in this example on a quadmaran, the control system 40 would be very similar for use on the cataraman of FIGS. 1 to 3.

Figure 2:
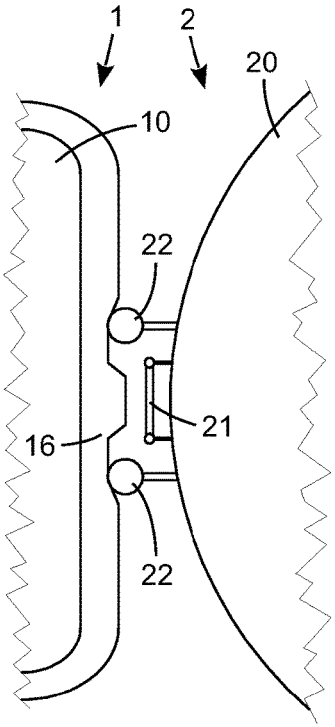
FIG. 2 is a partial plan view of the vessel of FIG. 1.

Returning to the control of the suspension system of the catamaran in FIGS. 1 to 3, if the friction forces are measured and used as an input into a control system, the suspension can be controlled to minimise the friction forces and thereby provide an even larger safety margin against slippage between the chassis 10 and the poles 22.

For example, a dynamic simulation of vessel pole contact was performed for a sample vessel in four states: conventional (i.e. suspension locked); passive soft pitch suspension; active height control up to contact; and active force control. A +/−300 mm wave of 4.8 second period was input head on to the vessel and the thrust of the propulsion system was set to 50%.

In the conventional vessel pole contact simulation the suspension was locked rigid to allow a loose comparison to conventional fixed hull catamarans. As the water can flow between the hulls and the body this will still provide better results than a conventional catamaran with an enclosed tunnel. After the conventional vessel contacts the pole there is an initial swing in height after around 3 seconds as the fender on the chassis of the vessel slips from an initial pole contact position to a steady state position 350 mm higher, resulting in a bow upwards height offset on the pole. The steady state friction force swing for the conventional vessel model is 13 kN.

In the passive soft pitch vessel pole contact simulation, after the vessel contacts the pole there is again a (albeit around 30% smaller) vertical slip on the pole from the initial contact position to a steady state position around 250 mm higher. The steady state friction force swing is also reduced by around 30% to 9 kN. The pitch stiffness of the suspension system can be lower than the roll stiffness for example as is known from the Applicant's above referenced prior publications.

Measuring the bow height relative to the object (i.e. pylon) and averaging this over time, enables a set point to be chosen, then the bow height of the chassis can be actively controlled to this set point as the chassis contacts the pole. As soon as contact is made, the active bow height control can be deactivated and the pitch compliance of the suspension system can absorb the waves. In this simulation, there is negligible slippage of the chassis 10 on the poles 22. There is for this case a steady state friction force swing of 6 kn or less than 50% of the force swing of the conventional vessel simulation.

However, if in addition to using active bow height control prior to contacting the poles, the control system then switches to active force control, i.e. controlling in this example the pitch mode of the suspension system in dependence on the friction force between the chassis and the pylon, the safest contact is possible. In this case there is again negligible slippage of the chassis 10 on the poles 22, but most importantly, the steady state friction force swing is reduced to just 2 kn or approximately 15% of the force swing of the conventional vessel simulation. Clearly this provides not just minimal motion between the bow of the chassis and the poles 22 of the pylon 2, but also a significant safety margin.

If the wave height is increased to an amplitude at which the chassis slips relative to the pylon in each wave cycle and is unable to hold a steady state position, the conventional vessel limit wave amplitude is 325 mm, the passive soft pitch vessel limit wave amplitude is 425 mm, the active bow height vessel with control up to contact has a limit wave amplitude of 500 mm and the active force control vessel using friction force as a control input has a limit wave amplitude of 600 mm or almost double the wave height of a conventional vessel.

Figure 5:
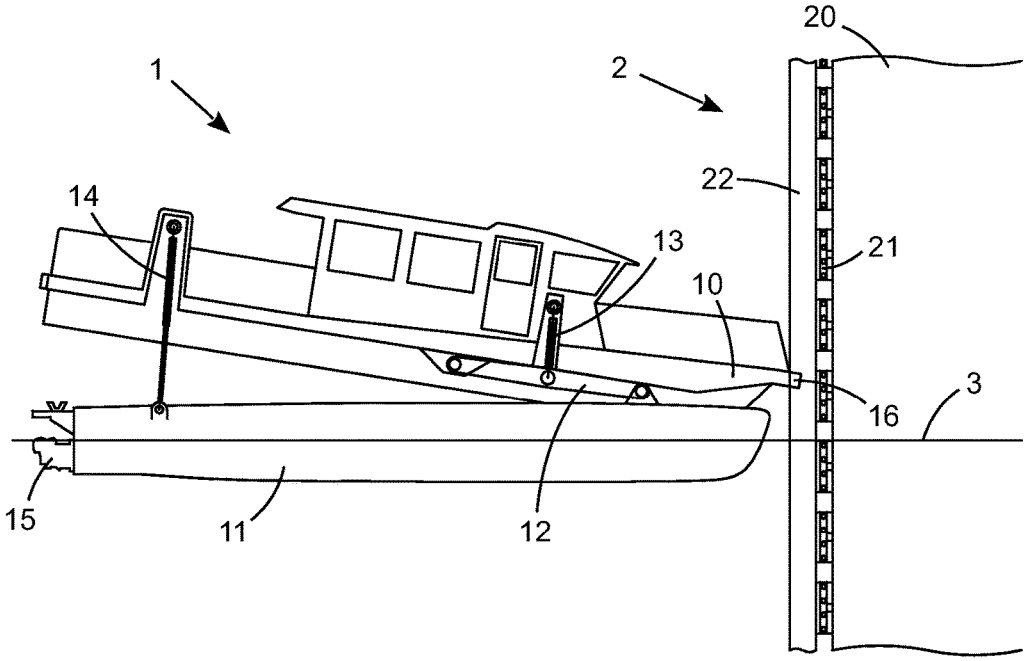
FIG. 5 is a schematic side view of the vessel of FIG. 1 in a first adjusted position.
Figure 6:
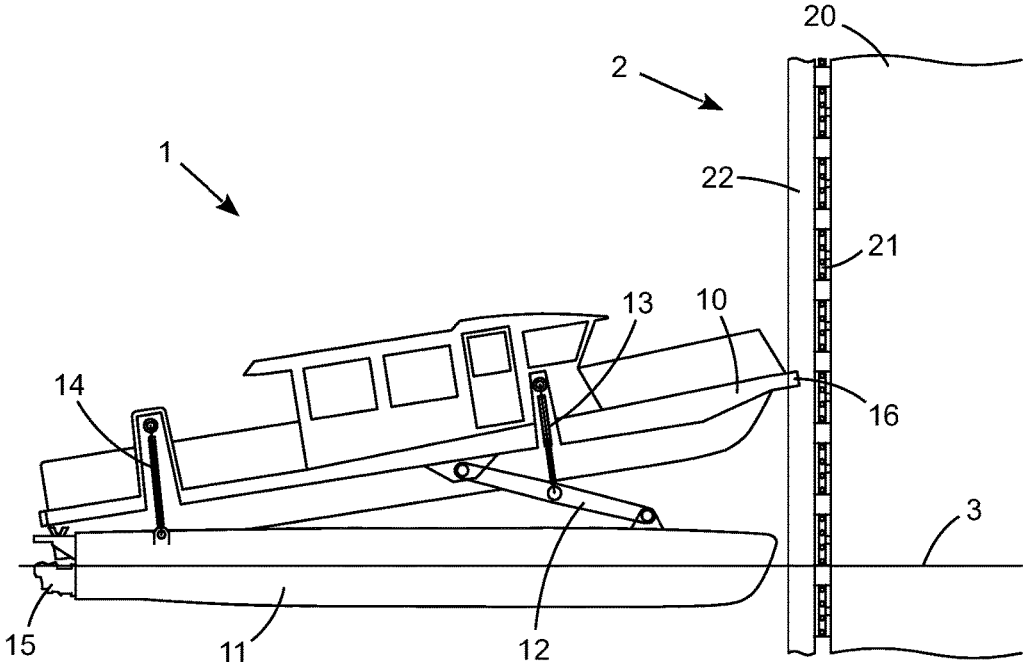
FIG. 6 is a schematic side view of the vessel of FIG. 1 in a second adjusted position.

In the above modelled example the chassis is allowed to pitch as shown in FIGS. 5 and 6 where the fender portion 16 of the chassis 10 maintains a fixed point of contact with the pole 22 on the pylon 20. The control system of FIG. 4 provides this type of control where the chassis is allowed to pitch. Prior to contact between the chassis and an object such as a pylon, the bow height sensor 52 can be used to measure the bow height relative to the object, then the average bow height can be used to determine a bow height set point. The pump 46 can be operated by the electronic control unit 48 and motor 47 to maintain the bow height at the set point until the fender 16 of the chassis 10 is docked with the poles 22 of the pylon 20. It is possible to also use the accelerometer 51 and/or the suspension system displacement and/or pressure sensors 50 to provide a bow height control incorporating heave or alternative characteristics as actuators reach stroke limits. Once the vessel contacts the pole the fender reaction sensors (not shown) can be used to determine that the contact reaction force is sufficient to change control algorithms from a bow height control to a friction force control taking the output from the fender friction force sensors 49 to determine whether the bow height needs to be adjusted up or down and if so by what magnitude. Again the pump 46 can be operated by the electronic control unit 48 and motor 47 to adjust the adjustable supports 13 and 14 to provide a pitch force or displacement between the hulls and the chassis portion and reduce the fender friction force whilst the fender 16 of the chassis 10 is docked with the poles 22 of the pylon 20.

Figure 7:
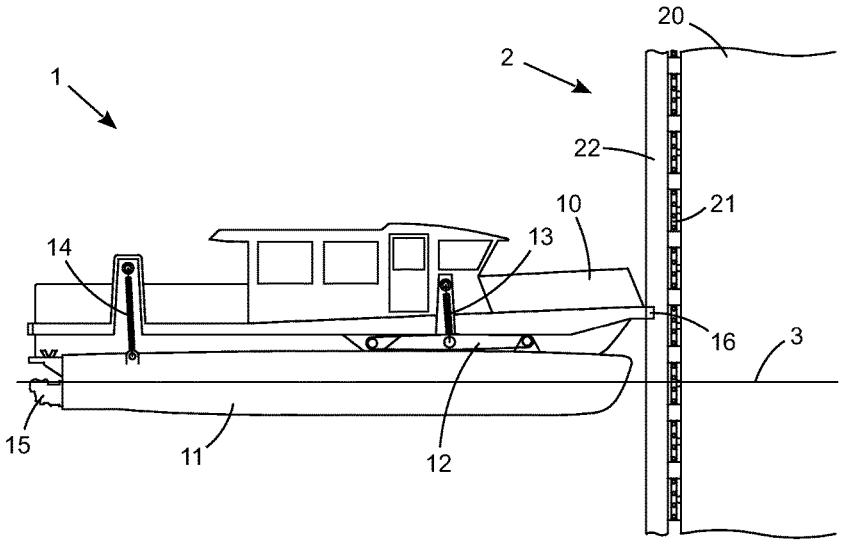
FIG. 7 is a schematic side view of the vessel of FIG. 1 in a third adjusted position.
Figure 8:
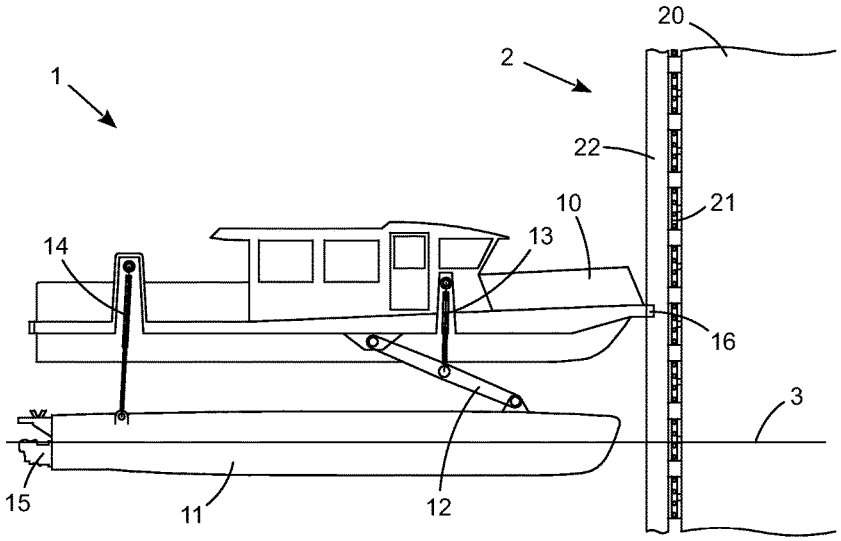
FIG. 8 is a schematic side view of the vessel of FIG. 1 in a fourth adjusted position.

While allowing the chassis to pitch in this manner allows the bow to maintain a steady height for a large amplitude of height change of the water surface 3, maintaining the chassis portion 10 level, i.e. horizontal, as shown in FIGS. 7 and 8, instead of pitching, improves passenger comfort but reduces the amplitude of height change of the water surface. Since using a fixed hull catamaran results in some pitching of the vessel, it can be acceptable from a comfort perspective and advantageous from a performance perspective to permit the control system to incorporate at least some pitching together with heave of the chassis into the docking control.

Instead of being fixed to the chassis of the vessel, the fender can alternatively be fixed to the pylon and can for example form part of a pylon load history system, the friction signal and/or the reaction force signal being transmitted for use as an input by the vessel control system.

The control system can include a docking or docked mode in which the suspension system is controlled in dependence on at least the friction force at the fender between the chassis of the vessel and the pole of the pylon. A user control input such as a mode selector can be used to initialise sensing of a friction force or preferable sensing of a reaction force to determine that the vessel is docked with a pylon. The mode selector can be a switch or an input on a touch screen or any other input device. Alternatively, the docked mode can be detected using reaction force either alone or in combination with other inputs such as propulsion thrust, speed or GPS position.

As friction force is a function of amongst other things, the reaction force, if the friction force is high or swing through a range that exceeds a predetermined proportion of the reaction force, ie more than 45, 50, 60 or say 75% of the reaction force, then to maintain a high safety margin, it is preferable to increase the reaction force. The thrust of the propulsion system of the vessel can be adjusted by the control system to increase the reaction force and therefore increase the safety margin of the vessel operation. Similarly, if the maximum friction force is less than a predetermined proportion (i.e. threshold) say 20 or 30% of the reaction force, the thrust of the propulsion system of the vessel can be adjusted by the control system to decrease the reaction force and therefore increase the efficiency of the vessel operation. These thresholds can be varied depending on whether there is a person transferring or whether the vessel is just readying for a transfer. For example, the pilot of the vessel or someone on the deck of the vessel near the transfer can press a button or other input device or automatic sensors can detect transfer activity and elect to increase the threshold, i.e. the safety margin, while a transfer is taking place, but the vessel can operate using a fuel efficient threshold while preparing for a transfer.

When the vessel withdraws away from the pylon or loses contact with the pylon, one or more sensors such as the reaction force sensor can be used to detect this and automatically exit the docked mode dependent on friction force.

The control system can include other modes of suspension control such as a bow height control mode prior to docking and at least one transit mode which can potentially be multiple transit modes dependent on sea state or speed for example.

The actuators of the suspension system may be independent or interconnected hydraulic or pneumatic rams, or electromagnetic actuators or any other known form of adjustable support. At least one motor must be provided to drive the adjustment of the adjustable supports, i.e. a motor driving a hydraulic or pneumatic pump or a linear electrical motor. Additional supports can be provided such as coil springs or air springs. When the adjustable supports are adjusted, they can change length, i.e. cause a displacement between the chassis portion and the at least two hulls, or they can change force, i.e. the support force changes with or without a displacement taking place, depending on the inputs and the other supports.

The suspension system can provide all of the support of the chassis portion above the hulls, or alternatively, if for example the chassis portion includes a water-engaging hull portion, then the suspension system provides only partial support of the chassis portion relative to the hulls.

The invention has been illustrated on a catamaran but can be applied to vessels with other numbers of hulls, although in most embodiments the adjustable supports include four adjustable supports, i.e. a front left, front right, back left and back right adjustable support. Each adjustable support can comprise more than one actuator or resilient support. For example, on a catamaran, the front left adjustable support is longitudinally spaced from the back left adjustable support, connected between the left hull and the chassis portion either directly or indirectly such as via suspension arms. Similarly the front right and back right adjustable supports are longitudinally spaced on the right hull both being directly or indirectly connected between the right hull and the chassis. The front (left and right) adjustable supports providing at least partial support of the forward portion of the chassis while the back adjustable supports provide at least partial support of the rearward portion of the chassis.

The friction force based control system of the present invention can be applied to quadmarans where the front left adjustable support is connected between a front left hull and the chassis portion, the front right adjustable support is connected between a front right hull and the chassis portion, the back left adjustable support is connected between a back left hull and the chassis portion, and the back right adjustable support is connected between a back right hull and the chassis portion.

Where the above description of the drawings explained the example of the bow of the vessel contacting the pylon or other fixed or floating object, it can be used if the stern contacts the pylon or other fixed or floating object. Similarly, the left or right sides of the vessel can including the docking region between the chassis and the pylon or other fixed or floating object. If the docking region is on the left or right side of the vessel, the chassis can be permitted to roll instead of the pitch of the examples in FIGS. 5 and 6.

Modifications and variations as would be apparent to a skilled addressee are deemed to be within the scope of the present invention.

The invention claimed is:

1. A control system for controlling at least a suspension system of a multi-hulled vessel, the vessel including a chassis portion, at least two hulls moveable relative to the chassis portion, the suspension system providing support of at least a portion of the chassis above the at least two hulls, the suspension system including adjustable supports and at least one motor to enable adjustment of a support force and/or displacement of the adjustable supports, the control system including a fender friction force input for receiving at least one signal indicative of a friction force on a fender portion between a fixed or floating object and the vessel chassis portion, and in response to the fender friction force input, the control system being arranged to adjust the support force and/or displacement between the chassis portion and the at least two hulls to reduce or minimise the friction force on the fender portion.

2. A control system as claimed in claim 1 further including at least one fender friction force sensor for providing said at least one signal indicative of a friction force on the fender portion between the fixed or floating object and the vessel chassis portion.

3. A control system according to claim 2 wherein the fender portion is attached to the chassis of the vessel.

4. A control system as claimed in claim 1 further including at least one fender reaction force input for receiving a signal indicative of a reaction force between the chassis of the vessel and the fixed or floating object.

5. A control system according to claim 4 wherein the control system increases or decreases a propulsion thrust in dependence on the signals received by the at least one fender friction force input and the at least one fender reaction force input.

6. A control system according to claim 1 wherein the adjustable supports are adjusted to reduce or minimise the friction force on the fender portion.

7. A control system as claimed in claim 1 wherein the adjustable supports include four adjustable supports being a front left, a front right, a back left and a back right adjustable support.

8. A control system as claimed in claim 7 wherein the at least two hulls are a left hull and a right hull, the front left and back left adjustable supports being longitudinally spaced on the left hull and the front right and back right adjustable supports being longitudinally spaced on the right hull.

9. A control system as claimed in claim 7 wherein the at least two hulls are a front left hull, a front right hull, a back left hull and a back right hull, the respective front left or front right adjustable support being located between a forward portion of the chassis portion and the respective hull, and the respective back left or back right adjustable support being located between a rearward portion of the chassis portion and the respective hull.

10. A control system as claimed in claim 7 wherein when a forward or rearward end of the vessel is adjacent the fixed or floating object, the control system adjusts the front left and front right supports and/or the back left and back right supports to reduce or substantially eliminate the vertical force in the fender portion while allowing the chassis portion to pitch.

11. A control system as claimed in claim 7 wherein when a left or right side of the vessel is adjacent the fixed or floating object, the control system adjusts the front left and back left supports and/or the front right and back right supports to reduce or substantially eliminate the vertical force in the fender portion while allowing the chassis portion to roll.

12. A control system according to claim 1 wherein the fender is attached to the fixed or floating object.

13. A method of controlling a chassis portion of a vessel, the vessel including a chassis portion, at least two hulls and a suspension system providing support of at least a portion of the chassis above the at least two hulls, and a suspension control system, the suspension control system including at least two modes of operation including a docked mode, when in the docked mode, the method including the steps of:

sensing a friction force in a fender portion between the chassis of the vessel and a fixed or floating object, and in response to the sensed friction force, adjusting the suspension system to reduce or substantially eliminate the friction force in the fender portion.

14. A method according to claim 13 further including the step of determining when to enter or exit the docked mode, including detecting a docking mode position of a mode selector.

15. A method according to claim 13 further including the step of sensing at the fender portion a reaction force between the chassis of the vessel and the fixed or floating object.

16. A method according to claim 15 wherein the step of determining when to enter or exit the docked mode includes comparing the reaction force at the fender to at least one minimum value.

17. A method according to claim 13 wherein the step of adjusting the suspension system to reduce or substantially eliminate the vertical force in the fender portion includes:

adjusting the pitch attitude between the chassis portion and the at least two hulls of the vessel.

18. A method according to claim 13 wherein the step of adjusting the suspension system to reduce or substantially eliminate the vertical force in the fender portion includes:

adjusting the heave attitude of the chassis portion relative to the at least two hulls of the vessel.

19. A method according to claim 13 wherein the step of adjusting the suspension system to reduce or substantially eliminate the vertical force in the fender portion includes:

adjusting the roll attitude between the chassis portion and the at least two hulls of the vessel.

20. A method according to claim 13 wherein the fender is attached to the chassis of the vessel.

21. A method according to claim 13 wherein the fender is attached to the fixed or floating object.

* * * * *